US007180392B2

(12) United States Patent
Grothen et al.

(10) Patent No.: US 7,180,392 B2
(45) Date of Patent: Feb. 20, 2007

(54) COAXIAL DC BLOCK

(75) Inventors: Victor Matthew Grothen, Windsor, CA (US); Mark Robert Reiland, Santa Rosa, CA (US)

(73) Assignee: Verigy Pte Ltd, Singapore (SG)

( * ) Notice: Subject to any disclaimer, the term of this patent is extended or adjusted under 35 U.S.C. 154(b) by 102 days.

(21) Appl. No.: 10/859,560

(22) Filed: Jun. 1, 2004

(65) Prior Publication Data

US 2005/0264381 A1 Dec. 1, 2005

(51) Int. Cl.
*H01P 1/00* (2006.01)

(52) U.S. Cl. ..... 333/245; 333/24 C

(58) Field of Classification Search ..... 333/12, 333/24 C, 24 R, 206, 260, 245; 361/306.1, 361/328, 329

See application file for complete search history.

(56) References Cited

U.S. PATENT DOCUMENTS 4,945,318 A * 7/1990 Kabachinski et al. ..... 333/12
5,371,436 A * 12/1994 Griswold et al. ..... 315/58
5,726,851 A * 3/1998 Knapp ..... 361/104
5,796,315 A * 8/1998 Gordon et al. ..... 333/24 C
6,207,901 B1 * 3/2001 Smith et al. ..... 174/102 R
6,496,353 B1 * 12/2002 Chio ..... 361/306.1
6,798,310 B2 * 9/2004 Wong et al. ..... 333/24 C
7,026,703 B2 * 4/2006 Ueda ..... 257/532

OTHER PUBLICATIONS http://www.pasternack.com/pdf/catalog/other_products.pdf, Pasternack Enterprises, LLC, "Other Products Catalog 2002", p. 11.
http://www.inmetcorp.com/lmprddcb.htm#dcblock, Aeroflex/Inmet Inc. (last revised Apr. 14, 2004).

* cited by examiner

*Primary Examiner*—Robert Pascal
*Assistant Examiner*—Kimberly E Glenn

(57) ABSTRACT

A novel coaxial DC block with circumferential capacitive shielding is presented. The coaxial DC block includes an inner DC block electrically couplable to a first inner conductor of a first length of coaxial cable and electrically couplable to a second inner conductor of a second length of coaxial cable. The inner DC block provides a capacitance which capacitively couples the first inner conductor to the second inner conductor and blocks a first frequency range of interest. The inner DC block is electrically sealed and shielded by a capacitive sleeve that is concentrically arranged to form a Faraday cage around the inner DC block. The capacitive sleeve is electrically couplable to a first outer conductor of the first length of coaxial cable and electrically couplable to a second outer conductor of the second length of coaxial cable. The capacitive sleeve forms a circumferential capacitance that electrically circumferentially couples the first outer conductor to the second outer conductor and blocks a second frequency range of interest.

18 Claims, 9 Drawing Sheets

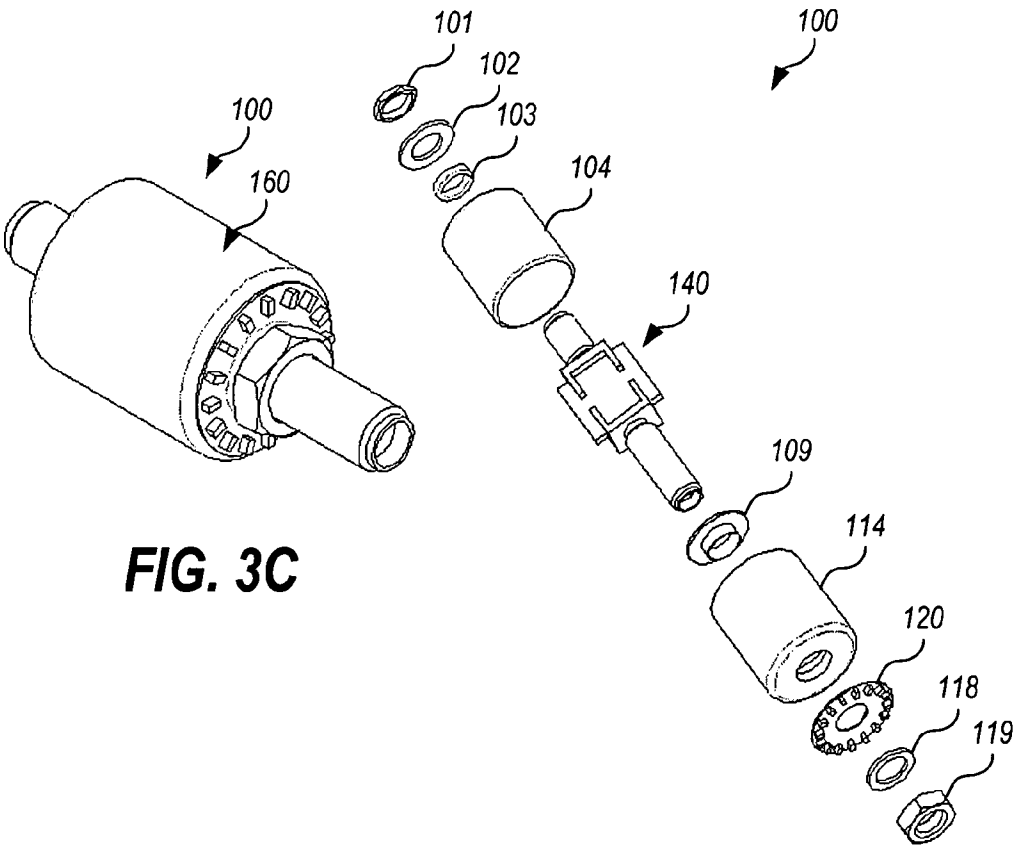
FIG. 3D
FIG. 3C
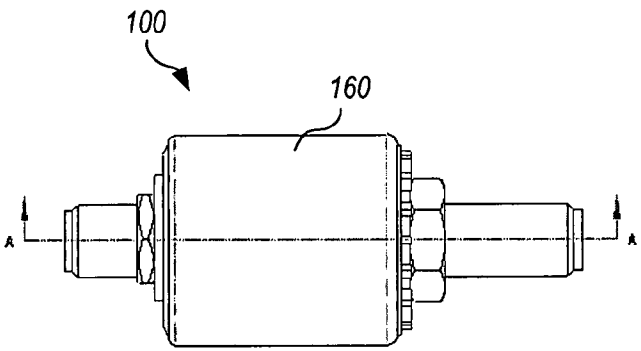
FIG. 3A
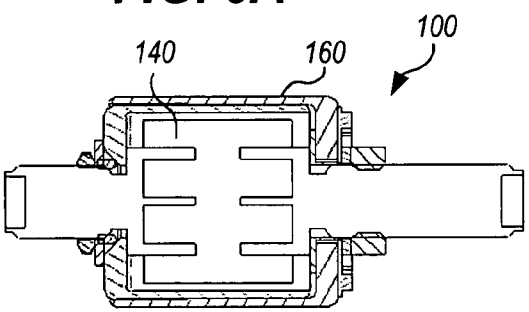
FIG. 3B

COAXIAL DC BLOCK

BACKGROUND OF THE INVENTION

As known in the art, a coaxial cable is formed of two concentric conductors separated by a dielectric. This unique construction results in the restriction of the electromagnetic field to the region between the inner and outer conductors, which results in near perfect shielding between fields inside and outside the cable.

Coaxial cables are generally used to propagate high-frequency signals from one electrical device to another. Generally, both electrical devices can be at the same ground potential. However, some applications, for example large systems that utilize both high and low frequency signals, may be susceptible to low frequency noise (e.g., approximately 1 kHz and below) caused by ground loops. In this case, it is desirable to break up potential ground loops. One way to do this is to break the ground connection in the coax line. For example, in industrial RF semiconductor testers, which require testing in both high and low frequency ranges (e.g., digital, low frequency analog, RF, etc.), the RF signals are generated in a separate rack and connected to the semiconductor test interface by way of one or more coaxial cables. The RF rack is tied to protective earth through the AC power connection or communications link. The semiconductor test interface may also be tied to protective earth through the handler (a device which automatically places the semiconductor onto the tester), AC power connection or communications link. Thus, the coax connection between the RF rack and semiconductor test interface may complete a ground loop between the RF rack and digital tester which can introduce low frequency noise. In this case, it is desirable to break the ground loop by breaking the coax connection at low frequencies where ground loops are an issue.

However, such a configuration is problematic. Even when two devices are both grounded though a common power connection or other means, the ground potential of each is slightly different depending on the electrical length and impedance of the connections. When one electrical device (or portion thereof) is grounded at one potential and the other electrical device is grounded at a different potential, the noise potential of the devices is different in magnitude and phase. Thus, when connected by way of a coaxial cable with a DC block, at low frequency a discontinuity exists in the ground on either side of the DC block. Due to this discontinuity, the ground noise potential on either side of the DC block is different. This results in noise being introduced into the system.

Accordingly, system designers have attempted to build a DC block which prevents DC current flow along the coaxial cable while permitting RF power to flow through the DC block. The general scheme in achieving this goal is to cut the coaxial cable, and then capacitively couple the two lengths of coaxial cable together with a capacitance that has a high impedance at DC and thus breaks up ground loops, yet effectively couples signals at higher frequencies. This solution is problematic due to the coaxial configuration of the coaxial cable transmission line. Although the insertion of a capacitor between the two inner conductors of the two lengths of coaxial cables is straightforward, the insertion of a capacitance between the two outer conductors of the two lengths of coaxial cables is problematic. The insertion of a capacitor between the two outer conductors of the two lengths of coaxial cables generally degrades the shielding characteristics of the coaxial cable and adversely affects the integrity of signals propagated through the coaxial cable.

Ideally, a DC block should have very low impedance on the outer conductor in the desired frequency range of signal propagation, and high impedance in the very low frequency range in order to break up ground loops. Of course, the actual values of these frequencies will depend on the application.

Although some DC blocks have been developed which capacitively break the outer coax connection, to date, these DC blocks do not have low enough impedance when the desired signal propagation frequency range includes lower frequencies (but greater than the very low frequencies seen on ground loops). Greater impedance at low frequencies can introduce low frequency noise on the propagated signals. In order to decrease the frequency at which the impedance of the outer connection begins to increase, the coupling capacitance needs to be dramatically increased in a way such that the impedance is very low across the continuous frequency band (no resonance points). In addition, the microwave structure needs to be maintained and the structure cannot be exposed to outside interference. In the prior art DC blocks, the outer connection is limited in capacitance due to its construction.

Accordingly, a need exists for a DC block that blocks very low frequency signals with high impedance, yet, at higher frequencies, maintains the electric field cancellation effect of standard coaxial transmission lines through the DC block.

SUMMARY OF THE INVENTION

The present invention is a novel coax DC block that dramatically increases the capacitance across the outer coax connection in such a way that the ground path impedance is very low as a function of frequency and outside interference is minimized.

By improving the coax ground connection, low frequency noise performance is improved while not degrading high frequency performance. Improvement will depend on system conditions and ambient noise conditions.

The coax DC block includes an inner DC block, a coaxial shielding sleeve, and a capacitive washer. The inner DC block breaks both the inner and outer coax connections. The outer coax connections are capacitively tied using internal layers of the PCB layers as plate capacitors as well as using discrete capacitors. The coaxial shielding sleeve combines with the capacitive washer to essentially form a capacitively tied Faraday cage, or capacitive sleeve, around the inner DC block.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein:

FIG. 3A is a side view of a preferred embodiment of a DC block for a coaxial cable implemented in accordance with the invention;

FIG. 3B is a cross-sectional side view of the DC block of FIG. 3A;

FIG. 3C is a perspective view of the DC block of FIGS. 3A and 3B;

FIG. 3D is an exploded view of the DC block of FIGS. 3A, 3B, and 3C;

DETAILED DESCRIPTION

Figure 1:
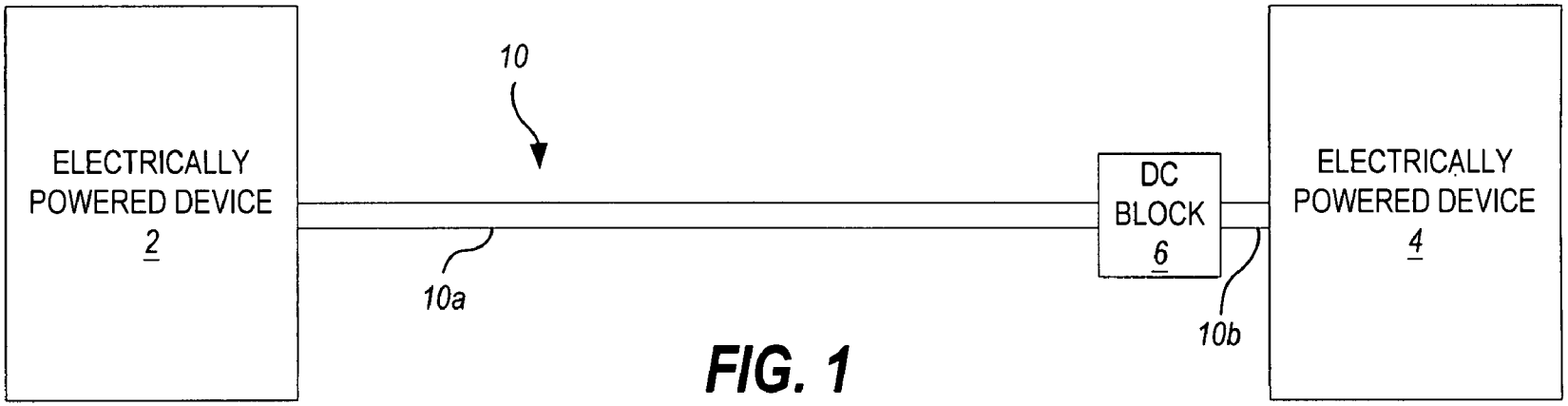
FIG. 1 is a block diagram illustrating a coaxial cable connection between two devices.

Turning now to the drawings, FIG. 1 illustrates a coaxial cable connection between two devices. A coax DC block is inserted in series along the coaxial cable connection in order to eliminate DC and low frequency voltage or current components while allowing high frequency signals.

Figure 2B:
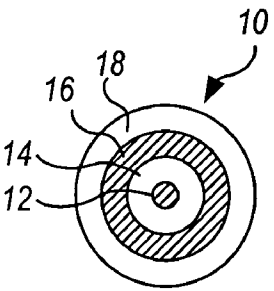
FIG. 2B is a cross-sectional view of the coaxial cable of FIG. 2A.
Figure 2A:
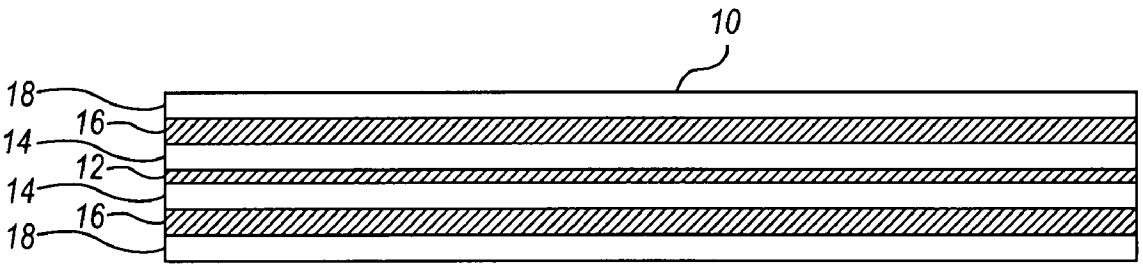
FIG. 2A is a cut-away view of a length of coaxial cable.

FIG. 2A is a cut-away view of a length of coaxial cable 10, and FIG. 2B is a view of a cross-section of the coaxial cable 10 of FIG. 2A. As shown therein, the coaxial cable 10 is formed of concentric inner and outer conductors 12 and 16, a dielectric 14 sandwiched between the inner conductor 12 and outer conductor 16, and an insulator 18 concentrically surrounding the outer conductor 16.

Figure 2C:
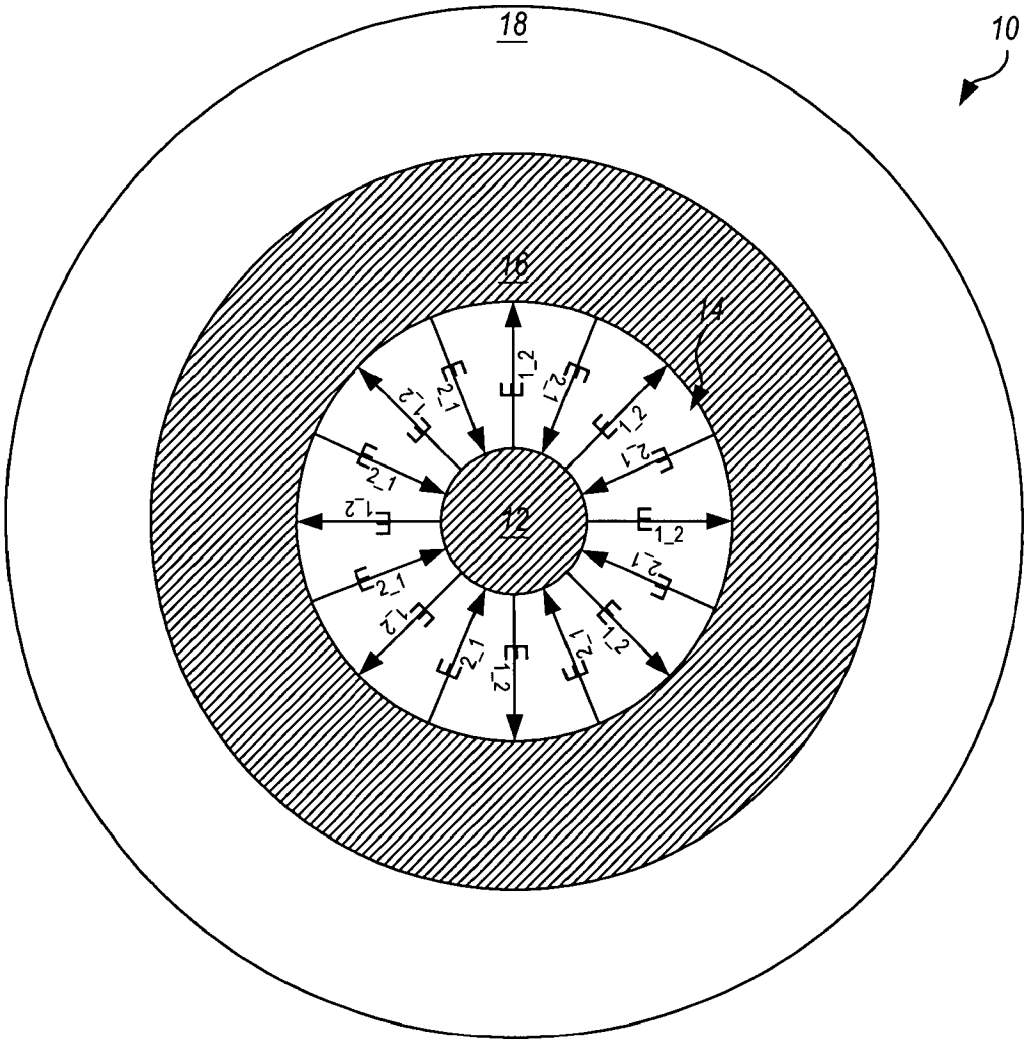
FIG. 2C is an electric field diagram illustrating the electric fields generated by a signal propagating along the coaxial cable of FIGS. 2A and 2B.
Figure 4D:
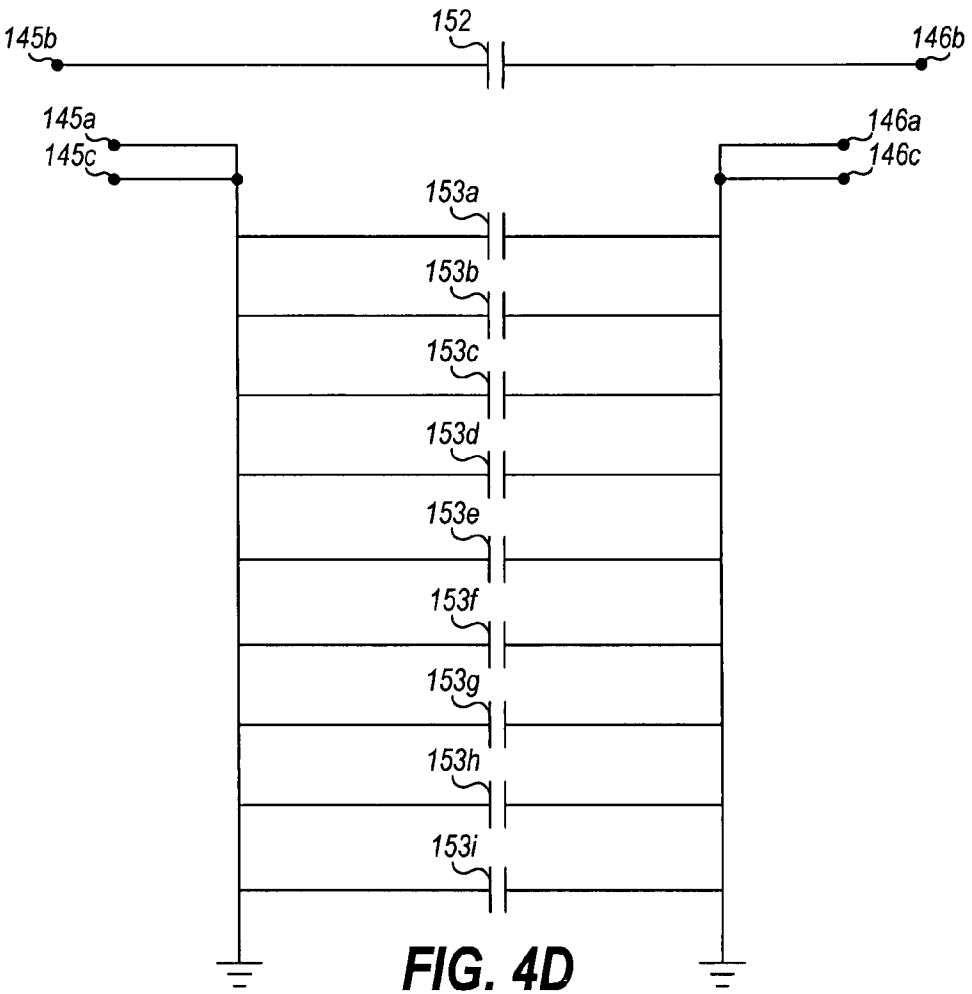
FIG. 4D is a schematic diagram of the printed circuit board of the inner DC block of FIG. 4A.
Figure 4A:
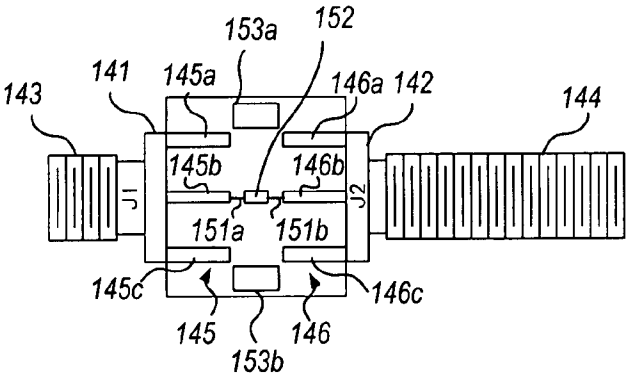
FIG. 4A is a top view of the inner DC block of FIGS. 3A–3D.
Figure 4B:
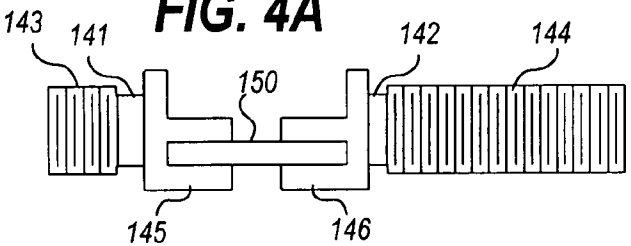
FIG. 4B is a side view of the inner DC block of FIG. 4A.
Figure 4C:
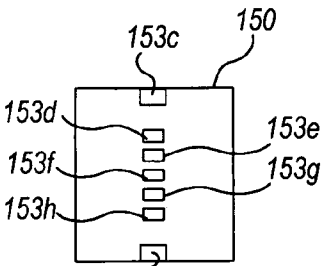
FIG. 4C is a bottom view of the printed circuit board of the inner DC block of FIG. 4A.
Figure 5E:
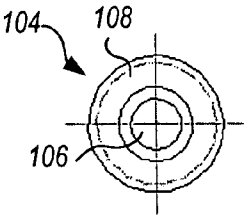
FIG. 5E is a view of the covered end of the inner cover of FIGS. 5A, 5B, 5C, and 5D.
Figure 5D:
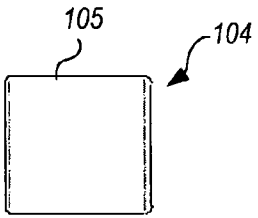
FIG. 5D is a view of the inner cover of FIGS. 5A, 5B, and 5C.
Figure 5C:
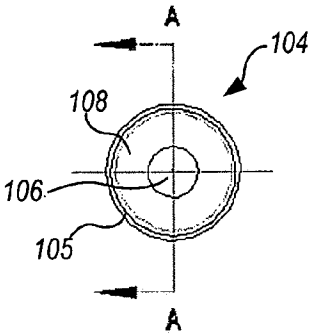
FIG. 5C is a view of the open end of the inner cover of FIGS. 5A and 5B.
Figure 5B:
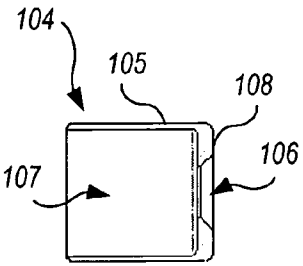
FIG. 5B is a cross-sectional side view of the inner cover of FIG. 5A.
Figure 5A:
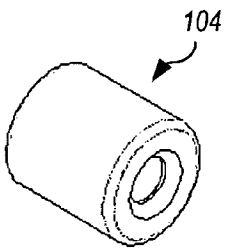
FIG. 5A is a perspective view of a preferred embodiment of the inner cover of FIGS. 3A–3D.
Figure 6A:
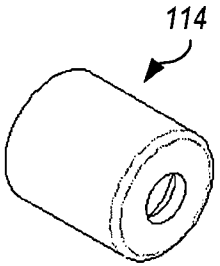
FIG. 6A is a perspective view of a preferred embodiment of the outer cover of FIGS. 3A–3D.
Figure 6D:
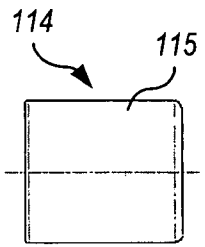
FIG. 6D is a view of the outer cover of FIGS. 6A, 6B, and 6C.
Figure 6E:
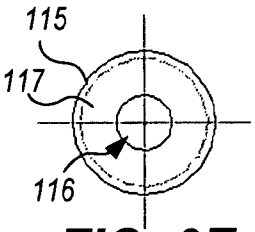
FIG. 6E is a view of the covered end of the outer cover of FIGS. 6A, 6B, 6C, and 6D.
Figure 6C:
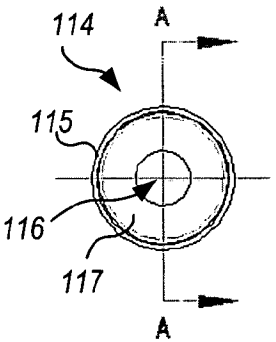
FIG. 6C is a view of the open end of the outer cover of FIGS. 6A and 6B.
Figure 6B:
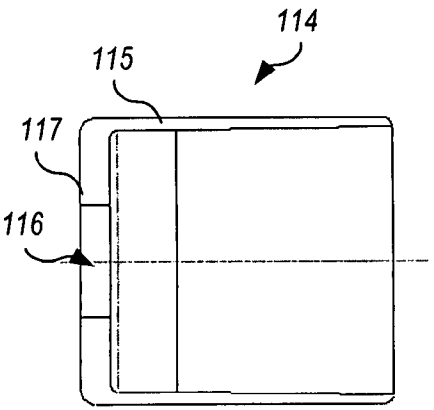
FIG. 6B is a cross-sectional side view of the outer cover of FIG. 6A.
Figure 7D:
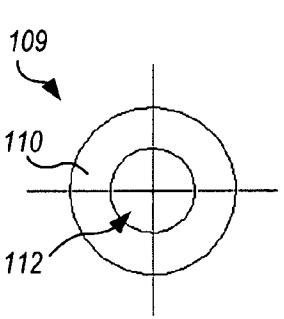
FIG. 7D is a rear view of the insulator of FIGS. 7A, 7B, and 7C.
Figure 7C:
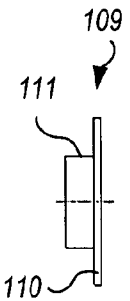
FIG. 7C is a side view of the insulator of FIGS. 7A and 7B.
Figure 7B:
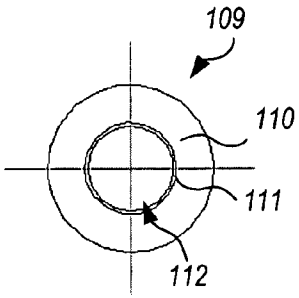
FIG. 7B is a front view of the insulator of FIG. 7A.
Figure 7A:
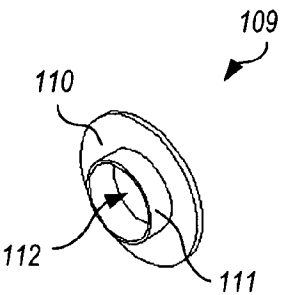
FIG. 7A is a perspective view of a preferred embodiment of the insulator of FIGS. 3A–3D.

FIG. 2C is an electric field diagram illustrating the electric fields generated by a signal propagating along the coaxial cable 10. According to standard electromagnetic field theory, the electric field $E_i$ generated by current flowing in one direction (e.g., into the page) on the inner conductor 12 radiates in from the inner conductor 12 to the outer conductor 16 in all 360° of the cross-sectional plane. The electric field $E_o$ generated by current flowing in the opposite direction (e.g., out of the page) along the return path of the outer conductor 16 radiates from the outer conductor 16 to the inner conductor 12 around all 360° of the cross-sectional plane. Thus, during signal propagation, the electric fields $E_i$ and $E_o$ of the inner and outer conductors 12 and 16 cancel each other out. The field cancellation effect thereby prevents radiation from the cable 10 and also operates to shield the cable 10 from outside interference.

A well-known solution for preventing the flow of DC and low-frequency current is to capacitively couple the grounds or return paths of RF-connected devices. However, capacitively coupling the ground/return paths of a coaxial cable is not a trivial task. The inner conductor 12 can be easily broken into two independent conductors, which may then subsequently be coupled together with a capacitor, even of a different structure (for example, as discussed hereinafter with respect to the inner DC block 140, from the inner conductor wire to a flat microstrip to a standard discrete capacitor). However, unless the outer conductor 16 is properly sealed, breaking the outer conductor 16 will allow electrical field radiation outside of the cable 10 and expose the signal propagating through the cable 10 to interference from outside signals.

FIGS. 3A, 3B, 3C, and 3D illustrate a preferred embodiment of a DC block 100 for a coaxial cable implemented in accordance with the invention. As illustrated, the DC block 100 generally includes an inner DC block 140 and a capacitive sleeve 160. The inner DC block 140 is electrically couplable at one end to a first inner conductor of a first length of coaxial cable and electrically couplable at an opposite end to a second inner conductor of a second length of coaxial cable and forms a capacitance between the first inner conductor of the first length of coaxial cable and the second inner conductor of the second length of coaxial cable. The capacitance is designed such that it blocks a first frequency range of interest.

The sleeve 160 is concentrically arranged around the inner DC block 140 and electrically seals the inner DC block 140 within its interior. The sleeve 160 is electrically couplable to a first outer conductor of the first length of coaxial cable and electrically couplable to a second outer conductor of the second length of coaxial cable. In this regard, coaxial cable coupling is preferably achieved using pairs of male/female Sub-Miniature Series A (SMA) connectors. SMA connectors essentially comprise a male connector consisting of a conductive pin extending from the center of a dielectric plug and a female connector consisting of a sleeve which receives and makes electrical contact with the pin. Standard SMA connectors utilize a threaded coupling or locking nut as the locking mechanism to connect the male and female connectors.

The cross-section of the sleeve 160 is preferably circular and forms a circumferential capacitance that electrically couples the entire circumference of the first outer conductor to the entire circumference of the second outer conductor. The circumferential capacitance is designed to block a second frequency range of interest. Because the sleeve 160 electrically seals the inner DC block 140 within its interior, the DC block is substantially perfectly shielded from fields inside and outside the sleeve 160.

Turning now in detail to the preferred embodiment of the DC block of the invention, FIG. 3D shows an exploded view of the coax DC block 100. As illustrated, the coax DC block 100 includes an inner DC block 140, an inner cover 104, a flat washer 102, a washer 103, an insulator 109, an outer cover 114, a capacitive washer 120, a flat washer 118, and a nut 119.

FIGS. 4A, 4B, 4C, and 4D illustrate a preferred embodiment of the inner DC block 140 in more detail. As shown therein, the inner DC block 140 includes a first coaxial SMA connector 143 with end-launch connector 141 and a second coaxial SMA connector 144 with end launch connector 142 electrically connected to a female SMA connector 144.

Each of the first and second coaxial end launch connectors 141 and 142 of respective SMA connectors 143 and 144 respectively include a mounting fork 145 and 146 comprising respective center tynes 145*b*, 146*b* and two outer tynes 145*a*, 145*c* and 146*a*, 146*c*. The female SMA connectors 143 and 144 each comprise a center conductor receiver (not shown) that is electrically coupled to the center tyne 145*b*, 146*b* of its respective coaxial end launch connector 141 and 142. The female SMA connectors 143 and 144 also each comprise an outer conductor receiver (not shown) that is electrically coupled to the outer tynes 145*a*, 145*c* and 146*a*, 146*c* of its respective coaxial end launch connector 141 and 142. The first and second coaxial end launch connectors 141 and 142 are mounted on opposite sides of an RF printed circuit board 150 by way of respective mounting forks 145, 146. The specifications of the SMA connectors 143 and 144 will of course depend on the type of coaxial cable used. In the illustrative embodiment, the coaxial cable is a 50 Ohm, 18 GHz, RG-58 cable, and the female SMA connectors 143 and 144 are implemented with an SMA End Launch Straight Bulkhead Jack Receptacle—Round Contact, Part No. 142-0711-811, available from Johnson Components, headquartered in Waseca, Minn.

The RF printed circuit board 150 includes a plurality of discrete capacitors. At least one capacitor 152 has a first terminal that is soldered to a microstrip (or trace) 151*a* on the printed circuit board (PCB) 150 and a second terminal that is soldered to a second microstrip (or trace) 151*b* on the PCB 150. When the RF printed circuit board 150 is mounted between the coaxial end launch connectors 141 and 142, the center tynes 145*b*, 146*b* of respective coaxial end launch connectors 141 and 142 are electrically connected (e.g., soldered) to the respective first and second microstrips 151*a*, 151*b*. Accordingly, the RF printed circuit board 150 operates to couple an inner conductor capacitance $C_i$ 152 between the respective first and second inner conductors of coaxial cables connected to the SMA connectors. Although the RF printed circuit board 150 is configured in the preferred embodiment with a single discrete capacitor 152 to provide the desired inner conductor capacitance $C_i$ between the inner conductors of the two incoming lengths of coaxial cable, those skilled in the art will appreciate that the inner conductor capacitance $C_i$ may alternatively be configured as any number of capacitors and/or other components that collectively provide the desired inner conductor capacitance $C_i$ 152 to filter out frequency components in a first frequency range of interest. In the preferred embodiment, the first frequency range $f_1$ of interest is $0<f_1<1$ kHz, and for signal propagation in the 10 MHz to 8 GHz range, the desired inner conductor capacitance $C_i$ 152 is 330 picofarads.

The RF printed circuit board 150 also includes capacitors 153*a*, 153*b*, 153*c*, 153*d*, 153*e*, 153*f*, 153*g*, 153*h*, 153*i* connected in parallel (by way of traces, vias, and solder connections) between outer tyne pads to which the outer tynes 145*a*, 145*c*, 146*a*, 146*c* of the respective end-launch connectors 141 and 142 are soldered during assembly. When assembled, the RF printed circuit board 150 operates to couple an outer conductor capacitance $C_o$ between the respective first and second outer conductors of coaxial cables connected to the SMA connectors. Although the RF printed circuit board 150 is configured in the preferred embodiment with a particular configuration (number and capacitance values) of capacitors 153*a*, 153*b*, 153*c*, 153*d*, 153*e*, 153*f*, 153*g*, 153*h*, 153*i* to provide the desired outer conductor capacitance $C_o$ between the outer conductors of the two incoming lengths of coaxial cable, those skilled in the art will appreciate that the outer conductor capacitance $C_o$ may alternatively be configured as any number of capacitors and/or other components that collectively provide the desired outer conductor capacitance $C_o$ to select the frequency components in a second frequency range of interest. In the preferred embodiment, the second frequency range $f_2$ of interest is the same as the first frequency range of interest, or $0<f_2<1$ kHz, and for signal propagation in the 10 MHz to 8 GHz, the desired outer conductor capacitance $C_o$ is 2 uF$<C_o<$3 uF.

The female SMA connectors 143 and 144 each include a center conductor and electrically isolated concentric outer conductor (generally referred to as the return path or ground). The outer surface of the female SMA connector is threaded. Male SMA connectors (not shown) are configured with a center pin and concentric outer conductor electrically isolated from the center pin. Each male SMA connector includes a rotatably attached threaded nut that, when fitted around the threaded shaft of a female SMA connector, may be rotated and tightened to securely connect the male and female SMA connectors together such that the inner conductor of the coaxial cable is electrically coupled to the center tyne of the end launch connector respectively attached to the respective female SMA connector. The ends of the two lengths of coaxial cable that are to be connected via the coax DC block 100 are electrically connected to male SMA connectors such that the respective inner conductors of the respective lengths of coaxial cables are electrically coupled to the center pins of the respective male SMA connectors and the respective outer conductors of the respective lengths of coaxial cables are electrically coupled to the concentric outer conductors of the respective male SMA connectors. Accordingly, when two lengths of coaxial cables are connected by way of the coax DC block 100 of the invention, the respective inner conductors of the two lengths of coaxial cables are capacitively coupled together via inner conductor capacitance $C_i$, and the respective outer conductors of the two lengths of coaxial cables are capacitively coupled together via capacitance $C_o$.

It will be appreciated that although the outer conductor capacitance $C_o$ operates to block DC and low-frequency current components on the outer conductor, the printed circuit board structure of the RF printed circuit board 150 alters the shape and direction of the electric fields within the coax DC block 100. Because the outer conductor of the coaxial cable has transitioned from a concentric coaxial configuration to a flat printed circuit board configuration, the shape of electric field also transitions from a radial electric field to a PCB-type electric field. This means that the field cancellation effect characteristic of coaxial transmission lines is broken by the RF printed circuit board 150, thereby eliminating the "perfect" shield of the overall coaxial line between the two electrical devices of interest and exposing the signals propagating therethrough to unwanted noise due to external field interference.

Accordingly, the coax DC block 100 also includes a coaxial shielding sleeve 160 that essentially forms a Faraday cage around the inner DC block 140. Returning to FIG. 3D, in the preferred embodiment, the coaxial shielding sleeve 160 is preferably formed with an inner cover 104, washer 103, washer 102, an insulator 109, an outer cover 114, a capacitive washer 120, washer 118, and nut 119.

In an alternative embodiment, a prior art DC block currently available on the market which includes extended SMA female connectors on both ends may be used to implement the inner DC block 140. In this embodiment, the entire prior art DC block would then be enclosed and electrically sealed within the coaxial shielding capacitive sleeve 160 in order to overcome the shielding degradation problems of the prior art DC block.

Returning now to the capacitive sleeve 160, FIGS. 5A, 5B, 5C, 5D, and 5E illustrate a preferred embodiment of the inner cover 104 used in the capacitive sleeve 160 of the preferred embodiment of the coax DC block 100. As illustrated, the inner cover 104 is a hollow cylindrical tube 105 formed around an axis and having an empty cavity 107 therein. One end of the cylindrical tube 105 is open, and the other end is covered with cover 108. A hole 106 concentric with the axis of the cylindrical tube 105 is formed in the cover 108. The diameter of the hole 106 is substantially equal to the diameter of the shaft of the female SMA connector of the inner DC block 140, and is preferably countersunk within the cover 108. Both the tube 105 and cover 108 are conductive. Preferably, the cylindrical tube 105 and cover 108 are formed as one integral unit.

FIGS. 6A, 6B, 6C, 6D, and 6E illustrate a preferred embodiment of the outer cover 114 used in the preferred embodiment of the coax DC block 100. As illustrated, the outer cover 114 is also a hollow cylindrical tube 115 formed around an axis and having an empty cavity therein. One end of the cylindrical tube 115 is open, and the other end is covered with cover 117. A hole 116 concentric with the axis of the cylindrical tube 115 is formed in the cover 117. The diameter of the hole 116 is substantially equal to the diameter of the shaft of the female SMA connector of the inner DC block 140. Both the tube 115 and cover 117 are conductive, and preferably formed as one integral unit.

FIGS. 7A, 7B, 7C, and 7D illustrate a preferred embodiment of the insulator 109 used in the coax DC block 100. As shown, the insulator 109 includes a hollow cylindrical tube 111 formed around an axis. One end of the hollow cylindrical tube forms a flat washer 110 with a center hole 112 concentric with the axis of the cylindrical tube 111. Importantly, insulator 109 is formed of a non-conductive insulative material such as a dielectric (e.g., plastic, polyurethane, etc.).

Figure 8B:
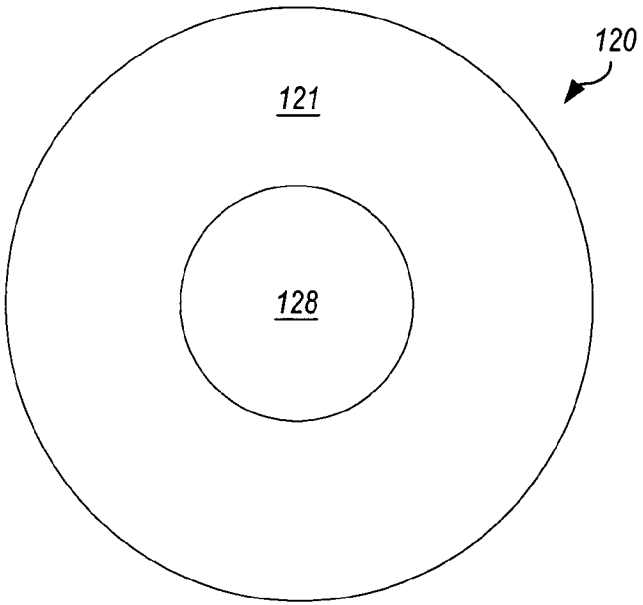
FIG. 8B is a bottom view of the capacitive washer of FIG. 8A.
Figure 8A:
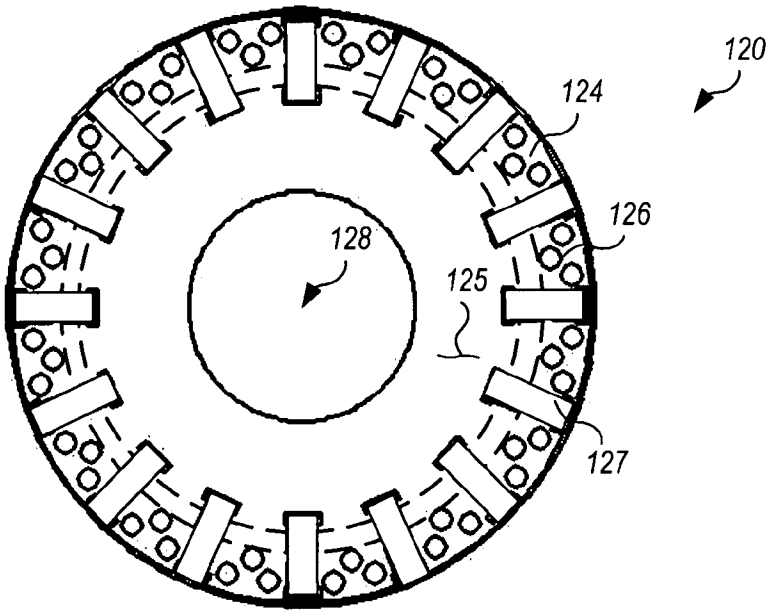
FIG. 8A is a top view of the capacitive washer of FIGS. 3A–3D.
Figure 8C:
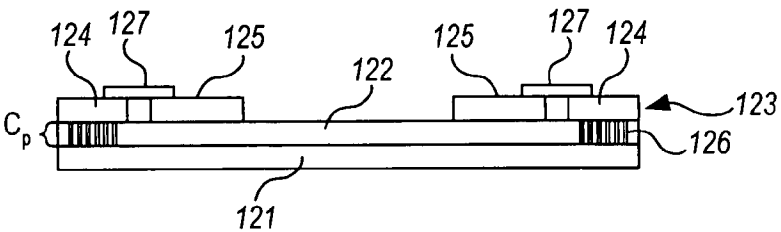
FIG. 8C is a side view of the capacitive washer of FIGS. 8A and 8B.

FIGS. 8A, 8B, 8C, and 8D illustrate a preferred embodiment of the capacitive washer 120 used in the coax DC block 100. Capacitive washer 120 is circular with a hole 128 of diameter substantially equal to that of the threaded shaft a female SMA connector formed in its center. The capacitive washer 120 is formed of a dielectric 122 sandwiched between a first conductive layer 121 and a second conductive layer 123. The first conductive layer 121 is essentially a solid sheet of conductive material layered (i.e., printed or laminated) on one surface of the dielectric 122. The second conductive layer 123 comprises an inner ring 125 and an outer ring 124 layered (i.e., printed or laminated) on the opposite surface of the dielectric 122. A plurality of vias 126 connect the outer ring 124 of the second conductive layer 123 with the first conductive layer 121. FIG. 8B illustrates that the inner ring 125 of the second conductive layer 123 is capacitively coupled to the first conductive layer 121 by a plate capacitance of $C_p$. The ring configuration of this capacitance $C_p$ provides coupling capacitance between the outer conductors of the two lengths of coaxial cables around the entire circumferences of the outer conductors. The capacitance $C_p$ is determined by a number of factors including the plate area, the distance between the plates, the dielectric constant, etc.

Figure 8D:
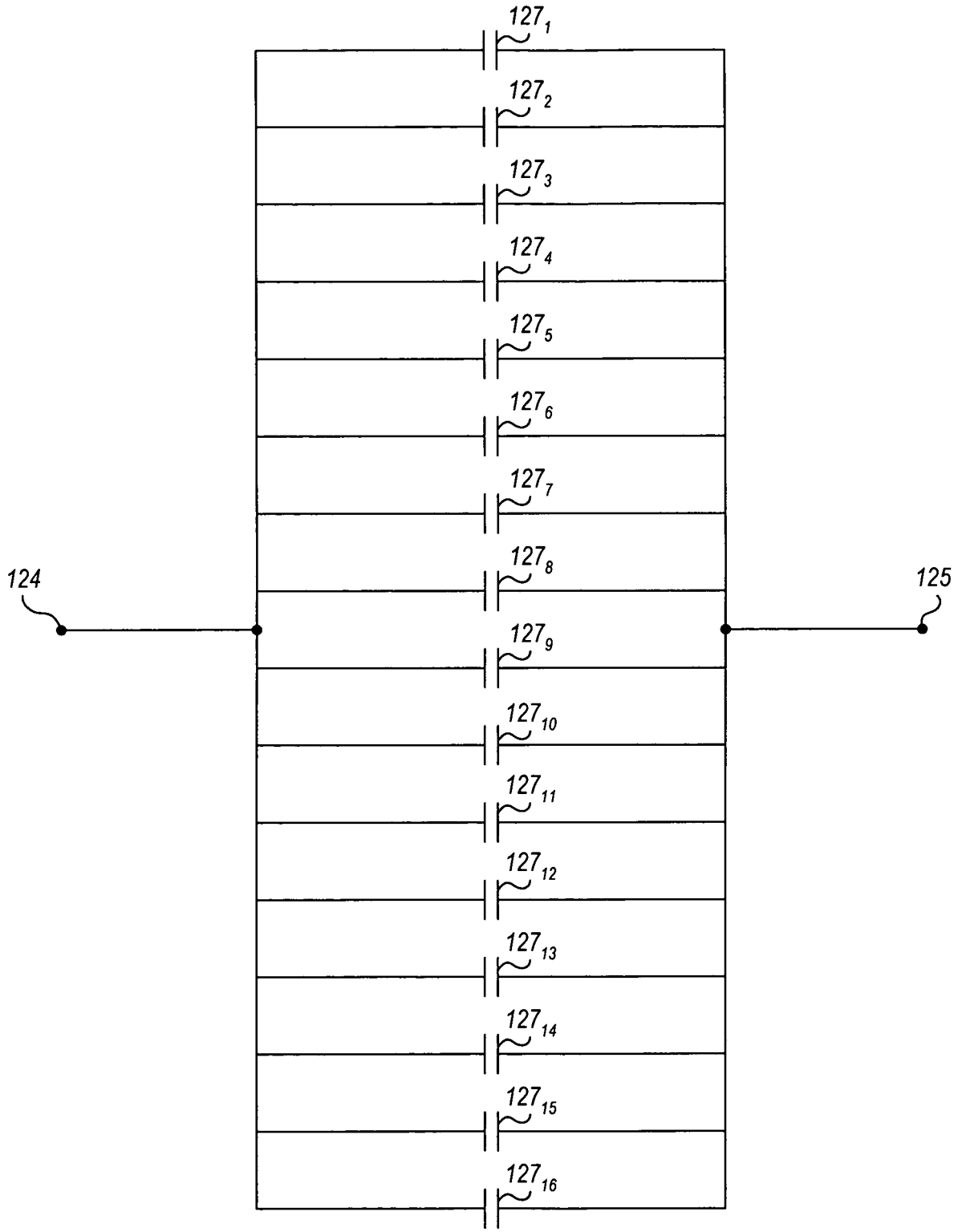
FIG. 8D is a schematic diagram of the discrete capacitors on the capacitive washer of FIGS. 8A, 8B, and 8C.

Depending on the impedance and frequency blocking requirements of the particular application (for example, when it is desired to block very low frequency signals), one or more discrete capacitors 127 may be capacitively coupled between the outer ring 124 of the second conductive layer 123 and the inner ring 125 of the second conductive layer 123. FIG. 8D shows the schematic equivalent of the discrete capacitors $127_1$–$127_{16}$ of the second conductive layer 123 used in the illustrative embodiment of the invention.

Table 1 provides sample capacitance values for the inner DC block 140 and capacitive washer 120 when the signal propagation frequency range of interest is 10 MHz to 8 GHz range.

TABLE 1

| Capacitor | Capacitance Value |
|---|---|
| 152 = $C_i$ | 330 pF |
| 153a | 1 uF |
| 153b | .1 uF |
| 153c | .01 uF |
| 153d | 1000 pF |
| 153e | 100 pF |
| 153f | 1000 pF |
| 153g | .01 uF |
| 153h | .1 uF |
| 153i | 1 uF |
| $C_o$ | 2 uF < $C_o$ < 3 uF |
| $127_1$ | 0.1 uF |
| $127_2$ | 0.1 uF |
| $127_3$ | 0.1 uF |
| $127_4$ | 0.1 uF |
| $127_5$ | 0.01 uF |
| $127_6$ | 0.01 uF |
| $127_7$ | 0.01 uF |
| $127_8$ | 0.01 uF |
| $127_9$ | 1000 pF |
| $127_{10}$ | 1000 pF |
| $127_{11}$ | 1000 pF |
| $127_{12}$ | 1000 pF |
| $127_{13}$ | 100 pF |
| $127_{14}$ | 100 pF |
| $127_{15}$ | 100 pF |
| $127_{16}$ | 100 pF |

To assemble the coaxial shielding sleeve 160, the inner DC block 140 is inserted into the cavity 107 through the open end of the inner cover 104 such that the shaft of the first SMA connector passes through the hole 106 in the cover 108 of the inner cover 104. Washer 103 is mounted over the threaded shaft of the SMA connector followed by the washer 102. The connector nut 101 secures washer 102 and washer 103 in place abutted against the outside surface of the cover 106 of the inner cover 104.

The insulator 109 is mounted over the shaft of the second SMA connector such that the shaft passes through the hole 112 of the insulator 109. The assembly thus far is then inserted, second SMA connector first, into the open end of the outer cover 114 such that cylindrical portion 111 of the insulator 109 with the shaft of the second SMA connector therein passes through the hole 116 in the cover 117 of the outer cover 114. The outer cover 114 and inner cover 104 are press fitted together to form a closed cylindrical conductive cage around the inner DC block 140.

The capacitive washer 120 is then mounted over the threaded shaft of the second female SMA connector. Washer 118 is mounted over the shaft followed by the nut 119, which is then tightened such that the washer 118 abuts against the capacitive washer 120 until the first conductive layer 121 of the capacitive washer 120 conductively abuts against the outer surface of the cover 116 of the outer cover 114.

When assembled and connected between two electrical devices by coaxial cables having male SMA connectors attached to the female SMA connectors of the coax DC block 100, the coaxial shielding sleeve 160 is electrically coupled to the outer conductor of a first coaxial cable via first female SMA connector. On the other end of the coax DC block 100, the outer conductor of the second coaxial cable is electrically coupled, via washer 118 and nut 119, to the inner ring 125 of the capacitive washer 120. As described previously, the inner ring 125 of the capacitive washer capacitive washer 120 is capacitively coupled to the first conductive layer 121 of the capacitive washer 120, which is conductively connected to the cover 116 of the outer cover 114. Accordingly, the outer conductors of the first and second coaxial cables are capacitively coupled via the coax DC block 100. The capacitive sleeve 160 forms a "Faraday" cage around the inner DC block 140 thereby maintaining the electric field cancellation effect of the coaxial cable. The inner DC block 140 may therefore be implemented with very low impedance in the frequency range of the intended signal propagation, yet provide high impedance at very low frequencies to break up ground loops.

Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. A DC block couplable in series between a first coaxial cable and a second coaxial cable, said first coaxial cable comprising a first dielectric concentrically sandwiched between a first inner conductor and a first outer conductor concentric to said first inner conductor, and said second coaxial cable comprising a second dielectric concentrically sandwiched between a second inner conductor and a second outer conductor concentric to said second inner conductor, said DC block comprising:

an inner DC block electrically couplable between said first inner conductor of said first coaxial cable and said second inner conductor of said second coaxial cable to form a first capacitance which blocks a first frequency range of interest, and electrically couplable between said first outer conductor of said first coaxial cable and said second outer conductor of said second coaxial cable to form a second capacitance; and a capacitive sleeve concentrically arranged around said inner DC block that electrically seals said inner DC block, said capacitive sleeve electrically circumferentially capacitively coupling said first outer conductor to said second outer conductor to form a third capacitance, said second capacitance and said third capacitance which together block a second frequency range of interest.

2. A DC block in accordance with claim 1, wherein:

said first frequency range of interest is identical to said second frequency range of interest.

3. A DC block in accordance with claim 1, wherein said capacitive sleeve comprises:

a concentric tube electrically circumferentially cauplable to said first outer conductor of said first coaxial cable at a first concentric tube end;

a capacitive washer comprising a third dielectric sandwiched between a first conductive layer and a second conductive layer, said first conductive layer circumferentially electrically couplable to said concentric tube to electrically seal said inner DC block within said concentric tube, and said second conductive layer electrically circumferentially couplable to said second outer conductor of said second coaxial cable.

4. A DC block in accordance with claim 3, comprising:

a hole formed through said first conductive layer, said third dielectric, and said second conductive layer of said capacitive washer for allowing passage of at least said second inner conductor of said second coaxial cable through said capacitive washer.

5. A DC block in accordance with claim 3, wherein said second conductive layer comprises:

a first conductive area electrically isolated from said first conductive layer by said third dielectric;

a second conductive area concentrically arranged with said first conductive area and electrically coupled to said first conductive layer; and at least one discrete capacitor coupled between said first conductive area and said second conductive area.

6. A DC block in accordance with claim 5, comprising:

a hole formed through said first conductive layer, said third dielectric, and said second conductive layer of said capacitive washer for allowing passage of at least said second inner conductor of said second coaxial cable through said capacitive washer.

7. A DC block in accordance with claim 1, wherein:

said inner DC block comprises:

a first SMA connector having a center conductor couplable to said first inner conductor of said first coaxial cable and a first SMA outer conductor couplable to said first outer conductor of said first coaxial cable a second SMA connector having a center conductor couplable to said second inner conductor of said second coaxial cable and a second SMA outer conductor couplable to said second outer conductor of said second coaxial cable; and a printed circuit board comprising:

an inner conductor capacitance coupling said center conductor of said first SMA connector and said center conductor of said second SMA connector; and an outer conductor capacitance coupling said outer conductor of said first SMA connector and said outer conductor of said second SMA connector.

8. A DC block in accordance with claim 7, wherein:

said capacitive sleeve comprises:

a concentric tube electrically circumferentially couplable to said first SMA outer conductor of said first SMA connector at a first concentric tube end;

a capacitive washer comprsign a third dielectric sandwiched between a first conductive layer and a second conductive layer, said first conductive layer circumferentially electrically couplable to said concentric tube to electrically seal said inner DC block within said concentric tube, and said second conductive layer electrically circumferentially coupleable to said second SMA outer conductor of said second SMA connector.

9. A DC block in accordance with claim 8, comprising:

a hole formed through said first conductive layer, said third dielectric, and said second conductive layer of said capacitive washer for allowing passage of said second SMA connector through said capacitive washer.

10. A DC block in accordance with claim 8, wherein said second conductive layer comprises:

a first conductive area electrically isolated from said first conductive layer by said third dielectric;

a second conductive area concentrically arranged with said first conductive area and electrically coupled to said first conductive layer; and at least one discrete capacitor coupled between said first conductive area and said second conductive area.

11. A DC block in accordance with claim 10, comprising:

a hole formed through said first conductive layer, said third dielectric, and said second conductive layer of said capacitive washer for allowing passage of said second SMA connector through said capacitive washer.

12. A circumferential capacitor, comprising;

a dielectric sandwiched between a first conductive layer and a second conductive layer, said second conductive layer comprising an inner conductive ring and an outer conductive ring, the inner ring conductively isolated from the outer ring, and the outer ring conductively connected to the first conductive layer.

13. A circumferential capacitor in accordance with claim 12, wherein;

said first conductive layer, said dielectric, and said second conductive layer are formed on a printed circuit board.

14. A circumferential capacitor in accordance with claim 13, further comprising:

at least one via conductively connecting the outer ring to the first conductive layer.

15. A circumferential capacitor in accordance with claim 12, comprising:

a hole formed in said inner ring through said first conductive layer, said dielectric, and said second conductive layer.

16. A circumferential capacitor in accordance with claim 15, wherein:

said hole accommodates a concentric shaft of an SMA connector.

17. A circumferential capacitor in accordance with claim 12, further comprising:

at least one discrete capacitor coupled between said inner ring and said outer ring.

18. A circumferential capacitor in accordance with claim 17, wherein:

said first conductive layer, said dielectric, said second conductive layer, and said at least one discrete capacitor are formed on a printed circuit board.

* * * * *